United States Patent [19]

Hilzinger et al.

[11] 4,293,023

[45] Oct. 6, 1981

[54] METHOD AND DEVICE FOR THE MANUFACTURE OF METAL BANDS

[75] Inventors: Hans-Reiner Hilzinger, Maintal; Hans Hillmann, Rodenbach, both of Fed. Rep. of Germany

[73] Assignee: Vacuumschmelze GmbH, Fed. Rep. of Germany

[21] Appl. No.: 72,094

[22] Filed: Sep. 4, 1979

[30] Foreign Application Priority Data

Sep. 29, 1978 [DE] Fed. Rep. of Germany ..... 2842421
Oct. 26, 1978 [DE] Fed. Rep. of Germany ..... 2846628

[51] Int. Cl.[3] ..... B72D 11/06

[52] U.S. Cl. ..... 164/479; 164/423; 164/256

[58] Field of Search ..... 164/87, 423, 427, 429, 164/256; 425/6; 264/176 F, 164, 165

[56] References Cited

U.S. PATENT DOCUMENTS 4,150,706 4/1979 Reiniche et al. ..... 164/87

*Primary Examiner*—Robert D. Baldwin
*Assistant Examiner*—K. Y. Lin
*Attorney, Agent, or Firm*—Hill, Van Santen, Steadman, Chiara & Simpson

[57] ABSTRACT

A method and device for the manufacture of metal bands, particularly of an amorphous metal alloy is provided. The liquid alloy is deposited on a cooling body having a rapidly moving surface, upon which solidification into a metal band occurs. Concurrent with the cooling body surface movement, the cooling body and the melt stream are moved relative to one another at right angles to the direction of the melt stream. This additional movement allows utilization of the entire cooling body surface and not merely that in the plane of the melt stream.

8 Claims, 1 Drawing Figure

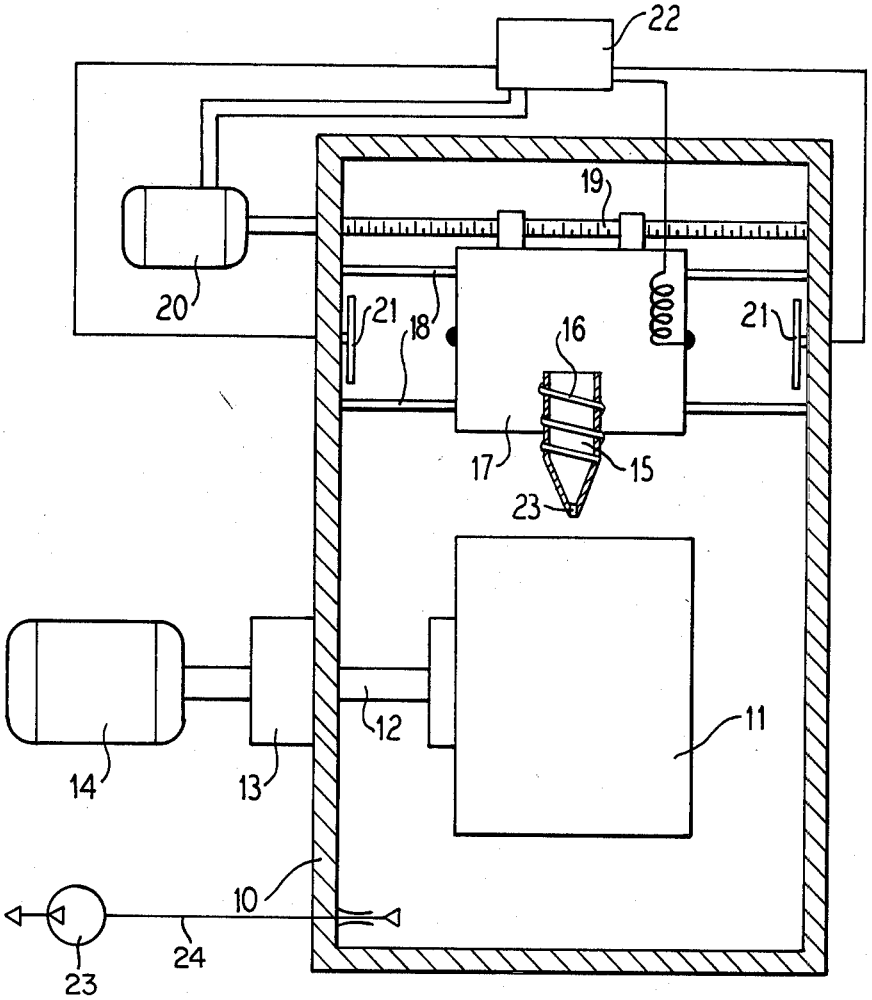
22
19
20
21
18
16
21
17
15
23
12
11
14
13
10
24
23

METHOD AND DEVICE FOR THE MANUFACTURE OF METAL BANDS

BACKGROUND OF THE INVENTION

1. Field of the Invention

The present invention relates to a method for the manufacture of metal bands, and more particularly to bands made from an amorphous metal alloy by directing a stream of the molten metel against a quickly moving cooling surface where the metal solidifies, and a device for its implementation.

2. Description of the Prior Art

Methods which permit the manufacture of metal bands directly from the melt are known. Metal bands with an amorphous structure are manufactured by quenching a melt so quickly, typically having a cooling rate of approximately $10^{6}$° C./second, that solidification without crystallization occurs. The inner or outer surface of a rotating drum or of a continuously circulating belt can, for example, serve as cooling surfaces for the stream of molten metal. The thickness of the bands obtained in this manner can amount to a few hundreths of a millimeter with a width of a few millimeters (cf., for example, U.S. Pat. No. 905,758, German O.S. No. 2,606,581, German O.S. No. 2,719,710 and German O.S. No. 2,746,238).

It has become apparent however, that in the manufacture of such metal bands, particularly when in a continuous operation, the heat load on the cooling surface caused by the striking of greater amounts of the molten metal on the same circumferential line presents a great problem. There is the increased danger that the surface temperature of the cooling body is raised whereby the rate of cooling or the cooling velocity of the molten metal is reduced. An embrittlement of the band can then occur which can lead to fracturing.

Of course, one can provide a water cooling system in the interior of the cooling body for quicker dissipation of the heat. This, however, is a relatively expensive solution. Moreover, in the known devices, an increasing waviness of the cooling body surface occurs after a short operating time, which causes the formation of surface irregularities on the band surface such as depressions and increased roughness.

SUMMARY OF THE INVENTION

Thus the present invention has as an objective the reduction in the heat load of the cooling body used in this type of metal band manufacture. In conjunction therewith, the surface quality of the bands is to be improved and premature fractures or ruptures as a result of embrittlement are to be avoided.

This is achieved by the method according to this invention by having the melt stream and the cooling body move at right angles relative to one another. A device for implementing the inventive method, having a cooling body surface rotating around at least one axis and a supply container for the molten metal alloy is also disclosed. The device is designed so that the discharge stream from the supply container moves at a right angle relative to the movement of the cooling body surface.

Utilization of both the method and the device according to this invention has effected a significant reduction in the apparent or practical heat load born by the cooling body during the continuous manufacturing operation. This occurs by having the stream of the molten metal continually strike a new circumferential line of the cooling body surface during the time of critical cooling.

It has proven particularly favorable when the cooling body is stationary while the melt stream is transversely moved. For the continuous manufacture of metal bands or tapes, it is desireable to have the velocity of the transverse movement small with respect to the surface velocity of the cooling body. Preferably, the cooling body is a quickly rotating cooling drum, since this is particularly easy to manipulate and has a relatively large mass. During longer operation, it can be advantageous to provide for an additional cooling of the cooling drum. To this end, it is sufficient to direct a stream of inert gas or air against the surface of the rotating cooling drum.

It is further advantageous when the cooling drum consists of pure copper with its high thermal conductivity. In principle, however, the cooling drum can consist of any desired material having a relatively high thermal conductivity such as copper-berrylium, or steel alloys.

Typical velocities for the longitudinal or rotational movement of the cooling surface of a cooling drum as a rule lie in the range of approximately 10 through 60 meters per second, (mps). However, a lower velocity of the cooling body is sufficient for the manufacture of metal bands having a polycrystalline structure.

The preferable velocity of the relative or transverse motion between the melt stream and cooling drum depends upon the width of the metal band to be manufactured. A velocity in the range of between 1 millimeter per second and 5 centimeters per second is principally suited for narrow bands, those up to a maximum width of approximately 10 mm; whereas velocities of 5 through 30 centimeters per second can be particularly favorably employed with wider bands. The problem to be avoided occurs where one works in the manufacture of very narrow bands and uses a velocity of the transverse motion in the range of 5 through 30 centimeters per second. At this velocity, there exists the danger that the bands will be bent in a sickle shape. In general the relative or transverse velocity is preferably at least two orders of magnitude smaller than the surface velocity of the cooling body.

So that the molten stream can repeatedly traverse the largest possible surface area of the moving cooling body, particularly when given greater melt amounts, it is further advantageous when means allowing for the periodic change of direction of the transverse motion are provided. For example, appropriately arranged electric contacts can enable the reversal upon the approach of the melt stream to an end of the cooling body. The maximum area for the relative motion of the melt stream at right angles to its direction of flow is of course limited by the width of the cooling body surface. However, it is generally preferable to make it somewhat smaller.

The method according to the invention can be carried out exposed to the atmosphere in a known fashion, in an inert atmosphere, for example, nitrogen or argon, or in a vacuum. Upon the employment of a vacuum, an improved uniformity of the metal band thus generated can be achieved with the suppression of the oxidizing attack of atmospheric oxygen. Therefore, the device can advantageously have a vacuum chamber in which the supply container for the melt and the cooling body are arranged.

Various other objects, advantages, and features of the present invention will become readily apparent from the ensuing detailed description and the novel features will be particularly pointed out in the appended claims.

BRIEF DESCRIPTION OF THE DRAWING

The FIGURE is an elevational view, partially in section, showing an embodiment of the present invention.

DESCRIPTION OF THE PREFERRED EMBODIMENTS

In the device illustrated in the FIGURE, the supply container 15 containing the molten metal and the moving cooling drum 11 are arranged in a vacuum chamber 10 which is connected with a vacuum pump via a vacuum line, both of which are schematically illustrated. The cooling drum 11 is driven by an electric motor 14 with any R.P.M. regulation mechanisms located outside of the vacuum chamber 10 via a shaft 12. An appropriate turning sleeve into the interior of the vacuum chamber 10 is referenced with 13. The supply container 15 which is surrounded with an induction heating coil 16 is mounted on a sub-frame 17 which can move on guide rails 18 at right angles to the longitudinal direction of the supply container 15. The sub-frame 17 is driven by an electric motor 20 likewise situated outside of the vacuum chamber 10 via a drive shaft 19. Upon touching one of the contacts 21, the direction of movement of the sub-frame 17 can be reversed, whereby the contacts 21 trigger a change of the rotary direction of the electric motor 20 via the control 22. The melt stream of liquid metal can emerge through an opening 23, for example, a nozzle, at the lower end of the supply container 15 and then strike the surface of the rotating cooling drum 11 where it solidifies into a continuous band.

This invention may be additionally described by reference to the following example.

For the manufacture of a metal band with amorphous structure, an alloy of the composition $Fe_{40}Ni_{40}P_{14}B_6$ was employed whose melting temperature lies at approximately 950° C. and whose crystallization temperature lies at approximately 360° C. The melt located in a quartz supply container was heated by means of an induction heating coil to approximately 1000° C. and was then pressed through a nozzle. The molten stream of this alloy struck the surface of a quickly rotating cooling drum which consisted of oxygen-free copper, where it solidified into a solid band. The velocity of the cooling drum surface in the longitudinal direction was set at approximately 30 mps. During discharge, the molten stream was moved at right angles to its discharge direction. The maximum excursion of this movement, whose direction could be reversed by means of contact at the area bounderies, amounted to approximately 15 cm. The velocity of the melt moving tranversely to the surface of the rotating cooling drum was at 15 centimeters per second. The amorphous metal band manufactured according to the method described was 5 mm wide and exhibited a uniform surface without any kind of waviness.

In further experiments, sickle-like curvature of the tapes occasionally occurred. The relative motion was then reduced from 15 centimeters to 1 centimeter per second. The 5 mm wide bands manufactured in that manner no longer exhibited any sickle-like curvature. Additional experiments showed that higher relative velocities are favorable in the manufacture of wider metal bands.

As a rule, one can regulate the transverse movement so that the width of the metal band to be manufactured should be covered by the relative motion of the melt stream to the cooling body in approximately 0.2 through 1 second. Thus, for example, velocities of the relative motion of 1 through 5 millimeters per second are favorable for bands of a 1 mm width and velocities of the relative motion between 1 and 5 centimeters per second are favorable for bands of a 10 mm width.

The inventive method and device are particularly suited for metal alloys which exhibit an amorphous structure after quick cooling from the melt. Since these alloys are metastable, a reduced cooling velocity, as a result of increasing heating of the surface of the cooling body to a temperature close to or above the so-called critical crystallization temperature, inevitably leads to the embrittlement of the tapes. Moreover, the inventive method and the appertaining device can also be employed in poly-crystalline metal alloys if it is likewise a matter of the advantage of a band manufacture directly from the melt.

The inventive device can also be varied in a known manner where one employs the inside of a rotating drum, two drums rotating with respect to one another, or a continuously circulating belt as the cooling body.

While we have disclosed an exemplary structure and method to illustrate the principles of our invention, it should be understood that we wish to embody within the scope of the patent warranted hereon all such modifications as reasonably and properly come within the scope of our contribution to the art.

We claim:

1. In a method for the manufacture of straight metal bands, particularly of an amorphous metal alloy, where a stream of the molten metal from a supply container strikes a quickly moving surface of a cooling body having a width transverse to said melt stream from which it is then removed as a substantially straight band after solidification, the improvement comprising:

additionally moving said supply container transversely relative to and substantially across the entire width of said cooling body at right angles to the direction of the melt stream for optimum utilization of the cooling property of the entire surface of said cooling body, wherein the velocity of the transverse movement of the melt stream is sufficiently small with respect to the surface velocity of the cooling body for generating a substantially straight metal band on said cooling body.

2. A method for the manufacture of metal bands as described in claim 1 which further comprises:

altering periodically the direction of relative movement of the melt stream and the cooling body.

3. A method for the manufacture of metal bands as described in claim 1 wherein the velocity of relative movement is selected between 1 millimeter per second and 5 centimeters per second.

4. A method for the manufacture of metal bands as described in claim 1 wherein the velocity of relative movement is selected between 5 and 30 centimeters per second.

5. A method for the manufacture of metal bands as described in claim 1 wherein the transverse movement between the melt stream and the cooling body is such that the relative motion of the melt stream to the cooling body covers a distance equivalent to the width of the metal band to be manufactured in approximately 0.2 through 1 second.

6. A device for manufacturing a straight metal band comprising:

a supply container for dispensing a stream of molten metal alloy;

a drum disposed below said supply container having a cylindrical cooling surface extending a full width of said drum;

a means for rotating said drum;

a means for moving said supply container in a slowly reciprocating path transverse to said stream across substantially the entire width of said cooling surface for optimum utilization of the cooling property of substantially the entire cooling surface, the velocity of said supply container being substantially less than the rotational velocity of said drum and cooling surface for applying said stream thereto such that said stream is cooled by said surface for removal as a substantially straight band.

7. A device for the manufacture of metal bands as described in claim 6, wherein said cooling drum consists of copper of high thermal conductivity.

8. A device for the manufacture of metal bands as described in claim 6 and which further comprises:

a vacuum chamber which hermetically receives the supply container and the cooling drum; and means for supplying a vaccum to said chamber, whereby the metal bands may be manufactured in a vacuum.

* * * * *